US010710216B2

(12) United States Patent
Lin

(10) Patent No.: US 10,710,216 B2
(45) Date of Patent: Jul. 14, 2020

(54) ADJUSTABLE POSITIONING DEVICE

(71) Applicant: SHERN YEONG PRECISE OPTICAL CO., LTD., Yilan County (TW)

(72) Inventor: Hsin-Yung Lin, Yilan County (TW)

(73) Assignee: SHERN YEONG PRECISE OPTICAL CO., LTD., Yilan County (TW)

( * ) Notice: Subject to any disclaimer, the term of this patent is extended or adjusted under 35 U.S.C. 154(b) by 107 days.

(21) Appl. No.: 16/141,485

(22) Filed: Sep. 25, 2018

(65) Prior Publication Data

US 2020/0094380 A1 Mar. 26, 2020

(51) Int. Cl.
*B66F 3/00* (2006.01)
*B25B 5/10* (2006.01)

(52) U.S. Cl.
CPC ..... *B25B 5/10* (2013.01)

(58) Field of Classification Search
CPC ..... B66F 1/00; B66F 1/06; B66F 3/00; B66F 3/08; B66F 5/00; B66F 5/025
See application file for complete search history.

(56) References Cited

U.S. PATENT DOCUMENTS 4,221,363 A * 9/1980 Jasper ..... B66F 3/08 248/354.4
5,971,362 A * 10/1999 Clark ..... E04F 21/1872 254/100
H001823 H * 12/1999 Wolford ..... 254/100
6,581,911 B1 * 6/2003 Scott ..... B66F 3/08 254/100
7,140,086 B2 * 11/2006 Heaton ..... E03C 1/2665 29/271

* cited by examiner

*Primary Examiner* — Lee D Wilson

(57) ABSTRACT

An adjustable positioning device includes a connection member, a positioning member and an adjusting member threaded onto the connection member and an adjustment structure including two protrusions respectively located on the positioning member and the adjusting member to face toward each other and an abutment surface extending upwardly and circularly from the bottom side of one protrusion toward the other protrusion. Subject to the design of the adjustment structure, the user can conveniently adjust the position of the positioning component set on the connection member to produce a positioning effect, or a positioning and tamper-proof effect.

1 Claim, 6 Drawing Sheets

ADJUSTABLE POSITIONING DEVICE

BACKGROUND OF THE INVENTION

1. Field of the Invention

The present invention relates to an adjustable positioning device, and more particularly to such an adjustable positioning device, which achieves a positioning effect or a positioning and tamper-proof effect by means of eliminating screw thread friction.

2. Description of the Related Art

The mechanisms currently used for positioning and tampering can be roughly classified into the following two types.

1. Machine a ring groove on the head of the screw; after the screw is tightened, continue to turn the head, so that the head is broken by the ring groove, leaving only the threaded shank locked in the workpiece. In this way, the head should be twisted with a large force, and the internal thread of the workpiece must have considerable strength to resist the torsion. It is easy to cause the thread to collapse during use, and the locking tightness cannot be adjusted according to the requirements of the workpiece.

2. A specially shaped groove is designed on the screw head, and special tool fitting the specially shaped groove is used for driving the screw into the locking position. This method cannot prohibit the screw from being removed by other people. Further, the use of a special tool brings inconvenience to the worker.

SUMMARY OF THE INVENTION

The present invention has been accomplished under the circumstances in view. It is therefore the main object of the present invention to provide an adjustable positioning device, which provides an adjustment structure, allowing the user to conveniently adjust the position of a positioning component set on a connection member so as to produce a positioning effect, or a positioning and tamper-proof effect.

To achieve this and other objects of the present invention, an adjustable positioning device comprises a connection member with a head, a positioning member and an adjusting member threaded onto the connection member, and an adjustment structure. The adjustment structure comprises two protrusions respectively located on the positioning member and the adjusting member to face toward each other, and an abutment surface extending upwardly and circularly from the bottom side of one protrusion toward the other protrusion. When rotating the adjusting member on the connection member toward the head after the two protrusions are abutted against each other, the positioning member is forced to rotate toward the head. When rotating the adjusting member on the connection member in direction away from the head after the two protrusions are abutted against each other, one protrusion is moved into abutment against the abutment surface to eliminate the screw pitch between the positioning member, the adjusting member and the outer thread, achieving a positioning effect.

DETAILED DESCRIPTION OF THE PREFERRED EMBODIMENT

Figure 1:
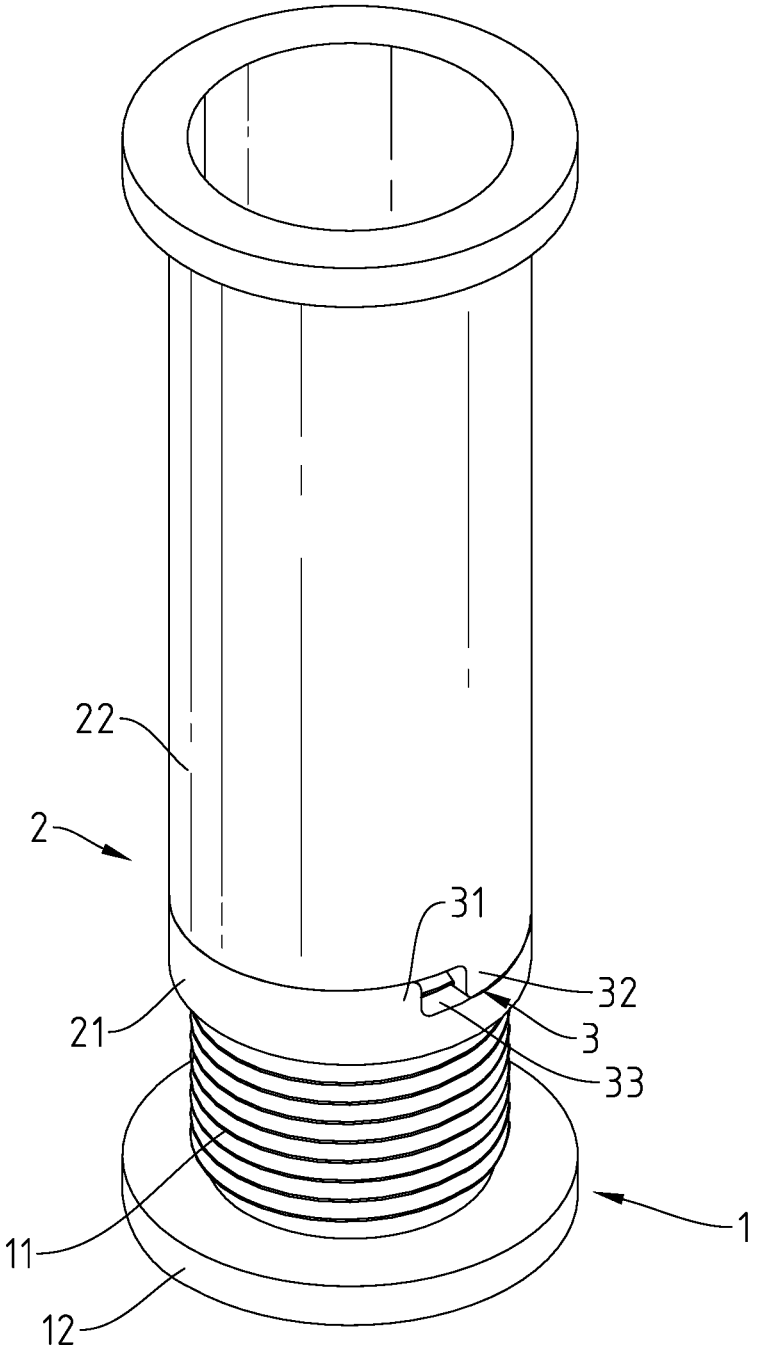
FIG. 1 is an oblique top elevational view of adjustable positioning device in accordance with the present invention.
Figure 2:
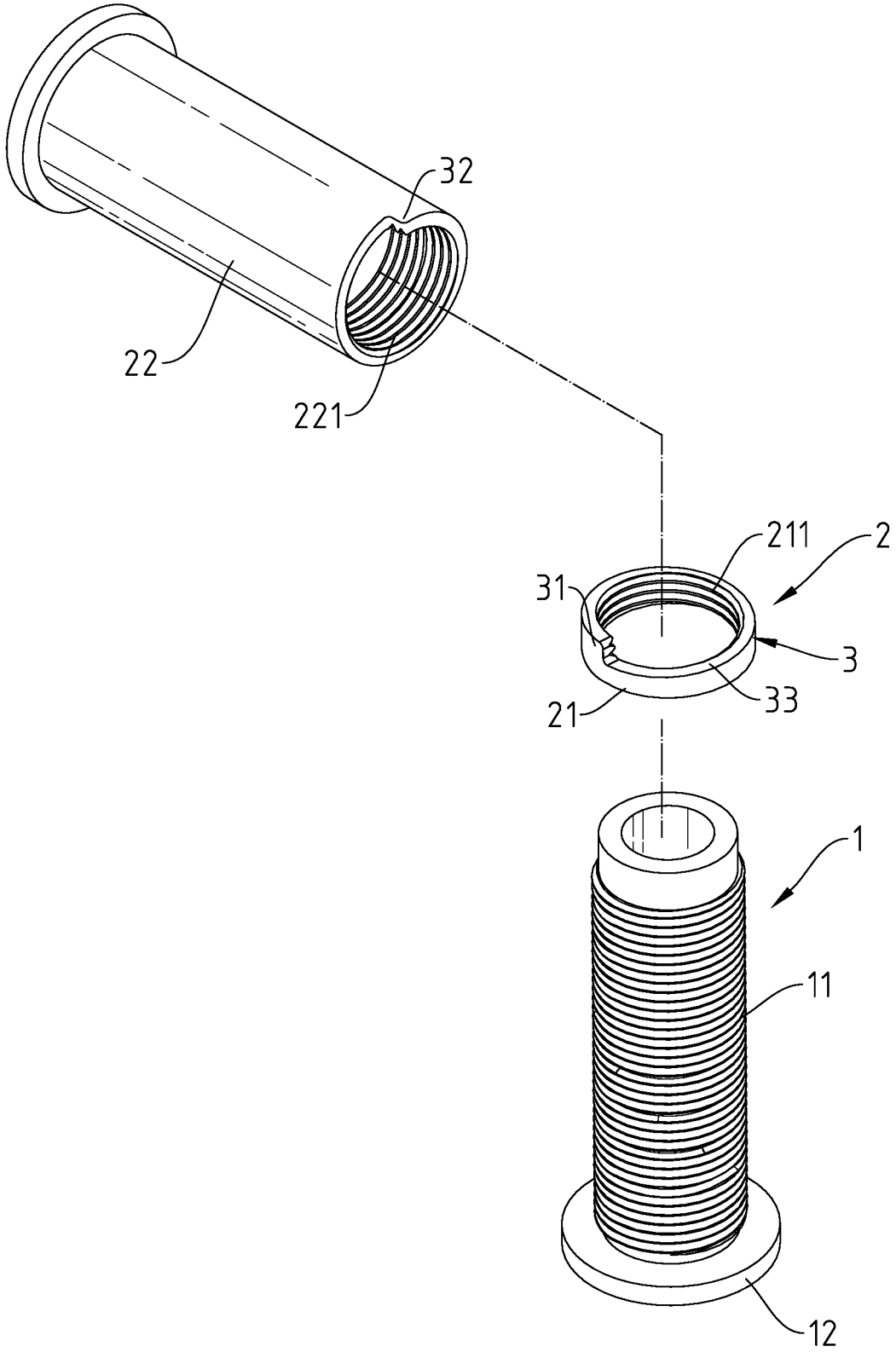
FIG. 2 is an exploded view of the adjustable positioning device in accordance with the present invention.
Figure 3:
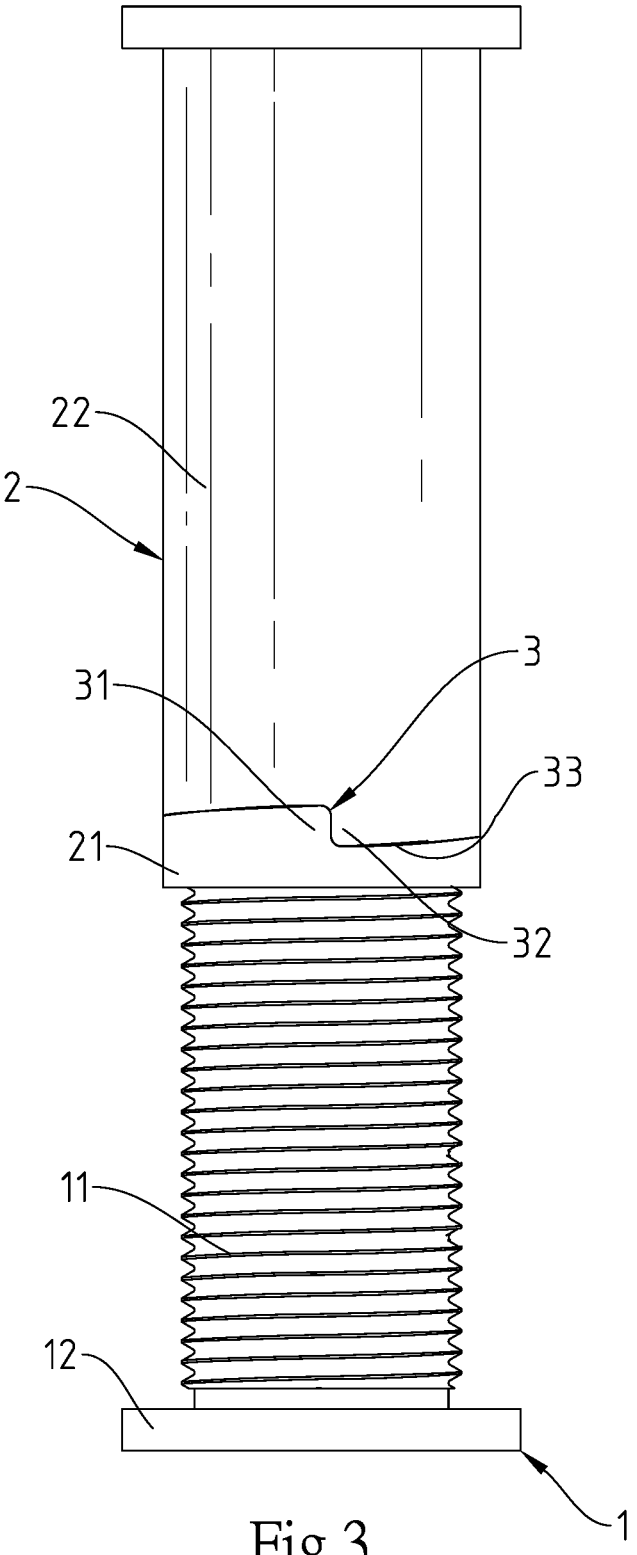
FIG. 3 is a schematic drawing of the present invention, illustrating the positioning component set threaded onto the connection member.

Referring to FIGS. 1-5, an adjustable positioning device in accordance with the present invention is shown. The adjustable positioning device comprises a connection member 1, a positioning component set 2 and an adjustment structure 3.

The connection member 1 comprises an outer thread 11 spirally extended around the periphery thereof and a head 12 located at one end thereof adjacent to one end of the outer thread 11.

The positioning component set 2 comprises a positioning member 21 and an adjusting member 22. The positioning member 21 comprises an internal positioning thread 211 spirally extending around an inside wall thereof. The adjusting member 22 comprises an internal adjusting thread 221. The positioning member 21 and the adjusting member 22 are respectively threaded onto the outer thread 11 of the connection member 1 by the internal positioning thread 211 and the internal adjusting thread 221. Further, the positioning member 21 is positioned adjacent to the head 12 of the connection member 1; the adjusting member 22 is disposed remote from the head 12 of the positioning member 21.

The adjustment structure 3 comprises a first protrusion 31, a second protrusion 32 and at least one abutment surface 33. The first protrusion 31 and the second protrusion 32 are respectively located on the positioning member 21 and adjusting member 22 of the positioning component set 2 to face toward each other. In this embodiment, the abutment surface 33 extends upwardly and circularly from a bottom side of the first protrusion 31 toward the second protrusion 32.

Figure 4:
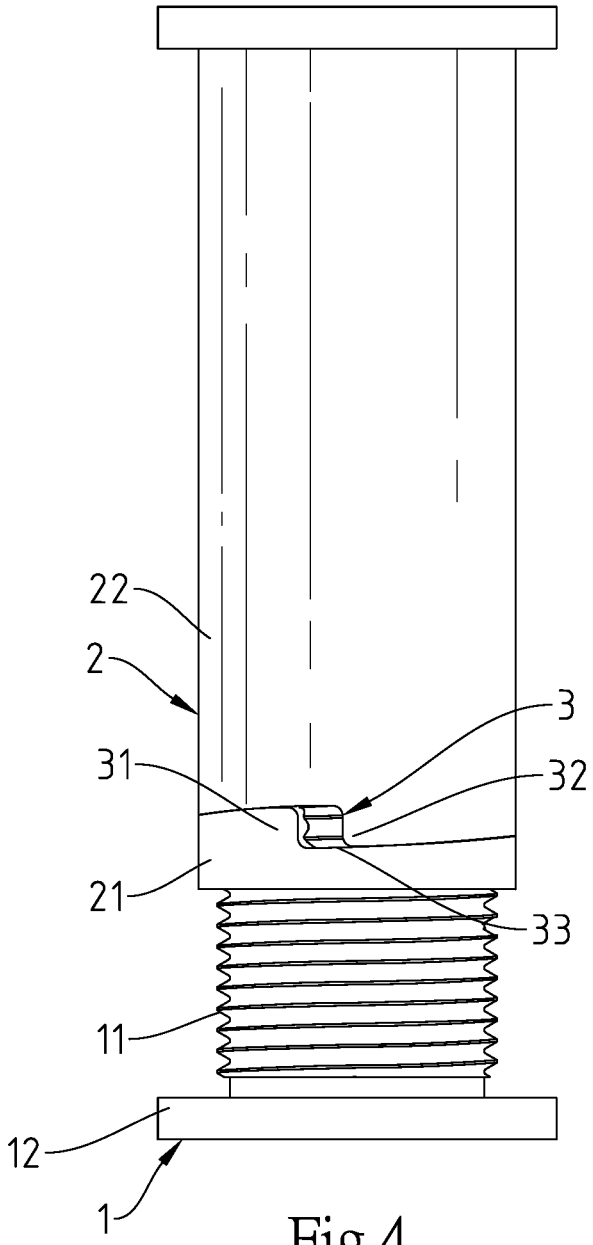
FIG. 4 corresponds to FIG. 3, illustrating the positioning component set properly positioned.

When using the adjustable positioning device of the present invention, thread the internal positioning thread 211 of the positioning member 21 of the positioning component set 2 onto the outer thread 11 of the connection member 1, then thread the internal adjusting thread 221 of the adjusting member 22 onto the outer thread 11 of the connection member 1, keeping the first protrusion 31 and the second protrusion 32 to face each other, and then rotate the adjusting member 22 to push the second protrusion 32 against the first protrusion 31, forcing the positioning member 21 to rotate with the adjusting member 22 toward the head 12. After rotated the adjusting member 22 to the proper position, as shown in FIG. 4, reversely rotate the adjusting member 22 in direction away from the head 12. At this time, the second protrusion 32 is gradually moved toward and into abutment against the abutment surface 33, eliminating the screw pitch between the internal positioning thread 211 of the positioning member 21, the internal adjusting thread 221 of the adjusting member 22 and the outer thread 11 and achieving a positioning effect. When to release the positioning effect, rotate the positioning member 21 in direction away from the head 12, forcing the first protrusion 31 to drive the second protrusion 32 in rotating the adjusting member 22.

Figure 5:
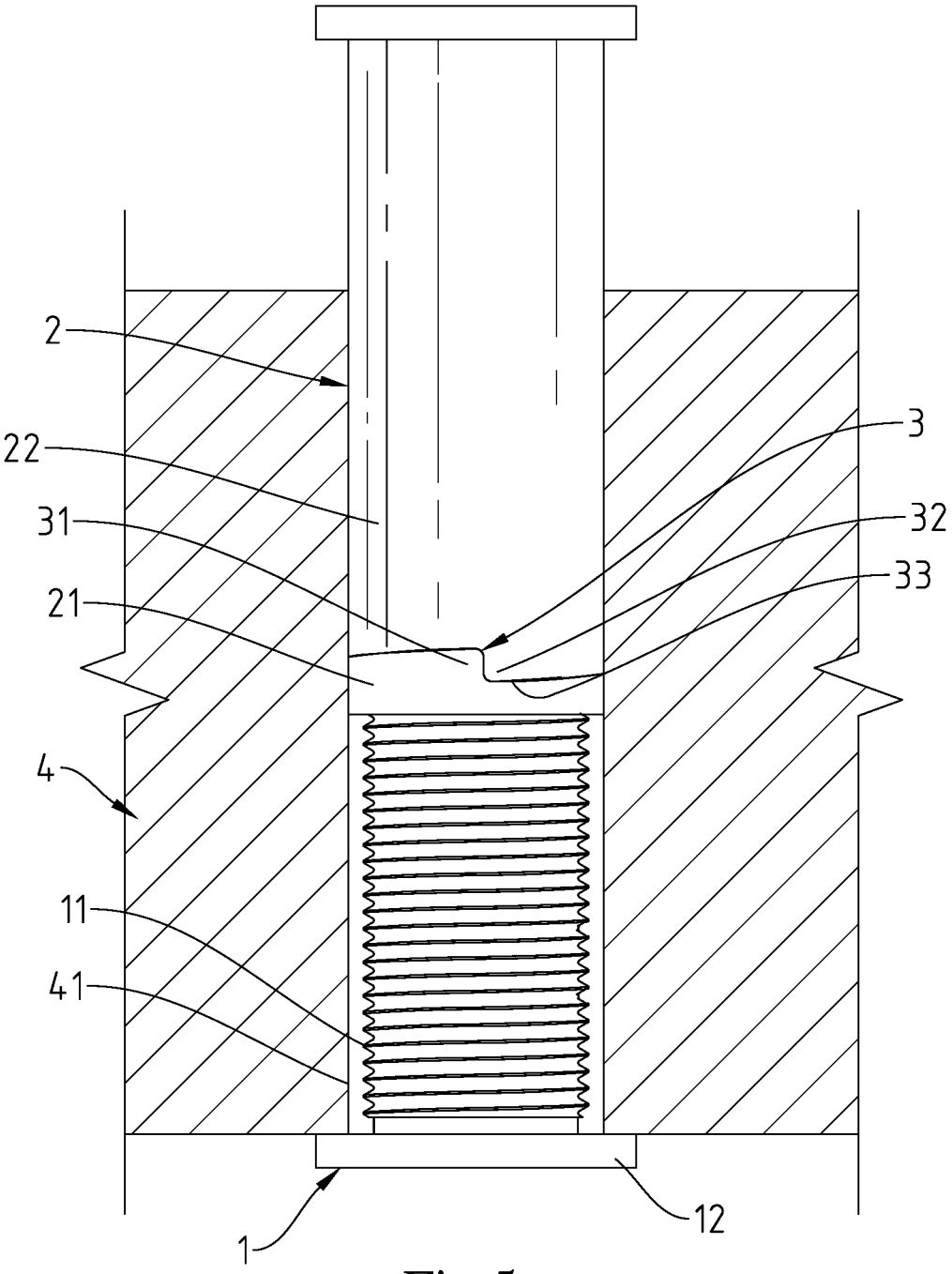
FIG. 5 is a schematic applied view of the adjustable positioning device in accordance with the present invention (I).
Figure 6:
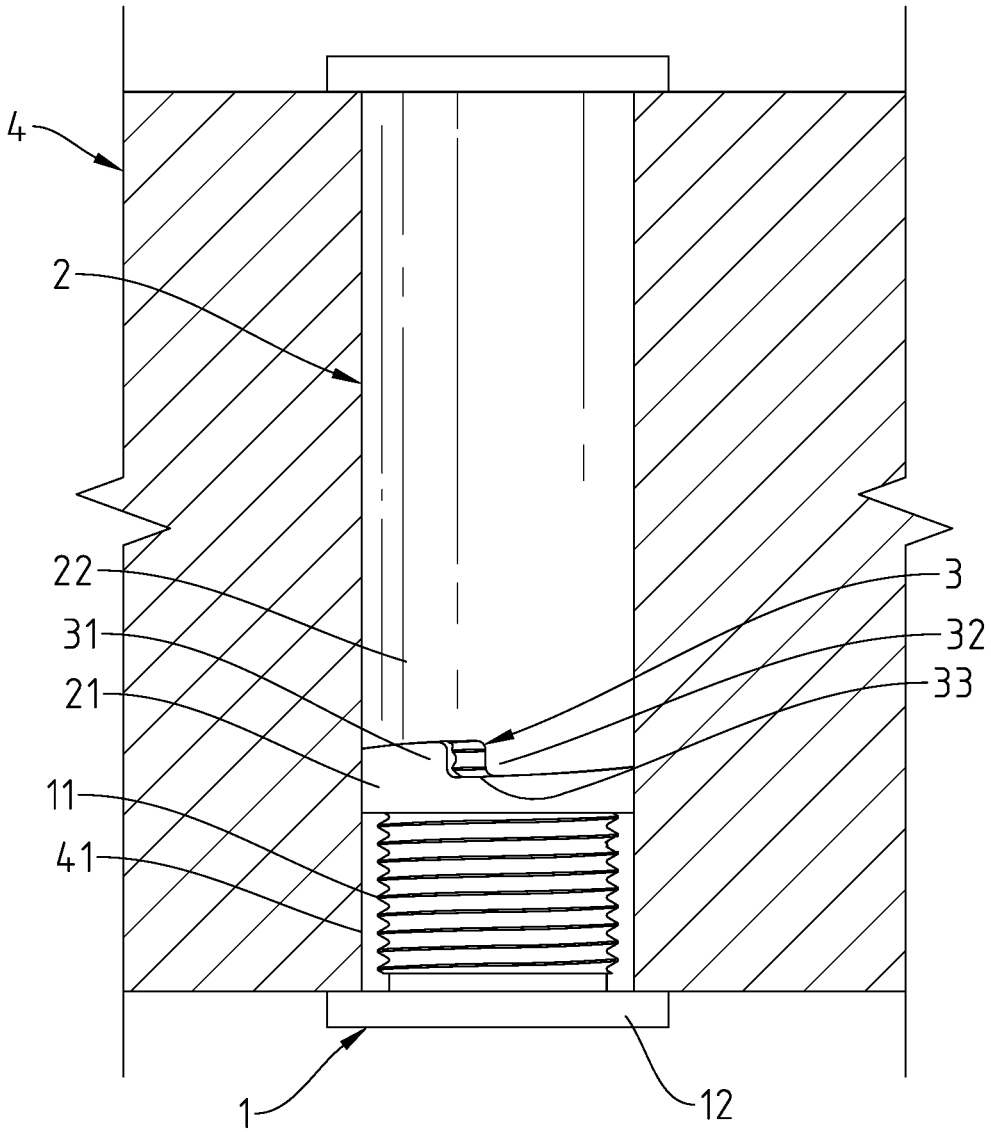
FIG. 6 is a schematic applied view of the adjustable positioning device in accordance with the present invention (II).

Referring to FIGS. 5 and 6, when using the present invention to produce a tamper-proof effect, enable the positioning member 21 of the positioning component set 2 to be positioned in the through hole 41 of the workpiece 4. At this time, rotating the positioning member 21 cannot release the positioning status of the positioning member 21 and the adjusting member 22, and thus, the desired positioning and tamper-proof effects are achieved.

What the invention claimed is:

1. An adjustable positioning device, comprising:

a connection member comprising an outer thread and a head at one end of said outer thread;

a positioning component set comprising a positioning member and an adjusting member respectively threaded onto said outer thread of said connection member, said positioning member being disposed adjacent to said head of said connection member, said adjusting member being disposed at one end of said positioning member remote from said head; and an adjustment structure comprising two protrusions and at least one abutment surface, said two protrusions being respectively located on said positioning member and said adjusting member of said positioning component set to face toward each other, each said abutment surface extending upwardly and circularly from a bottom side of one said protrusion toward the other said protrusion;

wherein when rotating said adjusting member on said connection member toward said head after said two protrusions are abutted against each other, said positioning member is forced to rotate toward said head; when rotating said adjusting member on said connection member in direction away from said head after said two protrusions are abutted against each other, one said protrusion is moved into abutment against one said abutment surface to eliminate the screw pitch between said positioning member, said adjusting member and said outer thread, achieving a positioning effect.

* * * * *